US011203806B2

(12) United States Patent
Matsunaga et al.

(10) Patent No.: US 11,203,806 B2
(45) **Date of Patent: *Dec. 21, 2021**

(54) COPPER ALLOY FOR ELECTRONIC AND ELECTRICAL EQUIPMENT, COPPER ALLOY PLATE STRIP FOR ELECTRONIC AND ELECTRICAL EQUIPMENT, COMPONENT FOR ELECTRONIC AND ELECTRICAL EQUIPMENT, TERMINAL, BUSBAR, AND MOVABLE PIECE FOR RELAY

(71) Applicant: MITSUBISHI MATERIALS CORPORATION, Tokyo (JP)

(72) Inventors: Hirotaka Matsunaga, Kitamoto (JP); Kazunari Maki, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 228 days.

This patent is subject to a terminal disclaimer.

(21) Appl. No.: 16/076,617

(22) PCT Filed: Mar. 29, 2017

(86) PCT No.: PCT/JP2017/012914

§ 371 (c)(1),
(2) Date: Aug. 8, 2018

(87) PCT Pub. No.: WO2017/170699

PCT Pub. Date: Oct. 5, 2017

(65) Prior Publication Data

US 2019/0048449 A1 Feb. 14, 2019

(30) Foreign Application Priority Data

Mar. 30, 2016 (JP) ..... JP2016-069080
Mar. 28, 2017 (JP) ..... JP2017-063418

(51) Int. Cl.
*C22C 9/00* (2006.01)
*C22C 9/02* (2006.01)
(Continued)

(52) U.S. Cl.
CPC ..... *C22F 1/08* (2013.01); *C22C 9/00* (2013.01); *C22C 9/02* (2013.01); *C22F 1/002* (2013.01); *H01B 1/026* (2013.01)

(58) Field of Classification Search
CPC ... C22F 1/08; C22F 1/002; C22C 9/00; C22C 9/02; H01B 1/026; H01B 1/02;
(Continued)

(56) References Cited

U.S. PATENT DOCUMENTS 3,677,745 A 7/1972 Finlay
3,778,318 A * 12/1973 Finlay ..... F28F 1/32 148/682
(Continued)

FOREIGN PATENT DOCUMENTS

CN 1574107 A 2/2005
CN 1924048 A 3/2007
(Continued)

OTHER PUBLICATIONS

Chinese Office Action dated Aug. 1, 2019 for the corresponding Chinese Patent Application No. 201780005558.0.
(Continued)

*Primary Examiner* — John A Hevey
(74) *Attorney, Agent, or Firm* — Leason Ellis LLP

(57) ABSTRACT

Provided is a copper alloy for electronic and electrical equipment including: 0.15 mass % or greater and less than 0.35 mass % of Mg; 0.0005 mass % or greater and less than 0.01 mass % of P; and a remainder which is formed of Cu and unavoidable impurities, in which a conductivity is greater than 75% IACS, and an average number of com-
(Continued)

pounds containing Mg and P with a particle diameter of 0.1 μm or greater is 0.5 pieces/$\mu m^2$ or less in observation using a scanning electron microscope.

14 Claims, 2 Drawing Sheets

(51) Int. Cl.
*H01B 1/02* (2006.01)
*C22F 1/08* (2006.01)
*C22F 1/00* (2006.01)

(58) Field of Classification Search
CPC ..... H01B 5/02; H01H 50/14; H01H 50/56; H01R 4/58; H01R 13/03
See application file for complete search history.

(56) References Cited

U.S. PATENT DOCUMENTS

| | | | | |
|---|---|---|---|---|
| 5,486,244 | A | 1/1996 | Caron | |
| 5,667,752 | A | 9/1997 | Suzuki et al. | |
| 10,128,019 | B2 | 11/2018 | Matsunaga et al. | |
| 10,157,694 | B2 * | 12/2018 | Ito | C22C 1/02 |
| 10,453,582 | B2 * | 10/2019 | Matsunaga | H01B 5/02 |
| 10,676,803 | B2 * | 6/2020 | Matsunaga | C22C 9/00 |
| 2002/0044881 | A1 | 4/2002 | Breedis | |
| 2004/0238086 | A1 | 12/2004 | Saleh | |
| 2008/0298998 | A1 | 12/2008 | Kaneko et al. | |
| 2009/0239398 | A1 | 9/2009 | Lynch | |
| 2010/0132851 | A1 | 6/2010 | Gao et al. | |
| 2010/0269963 | A1 | 10/2010 | Hirose | |
| 2011/0146855 | A1 | 6/2011 | Sakurai et al. | |
| 2013/0048162 | A1 | 2/2013 | Ito et al. | |
| 2014/0193293 | A1 | 7/2014 | Shishido et al. | |
| 2014/0209221 | A1 | 7/2014 | Kumagai et al. | |
| 2014/0283962 | A1 | 9/2014 | Ito et al. | |
| 2015/0037608 | A1 * | 2/2015 | Shinohara | H01R 13/03 428/673 |
| 2016/0160321 | A1 | 6/2016 | Ito et al. | |
| 2016/0201179 | A1 * | 7/2016 | Miyagi | C22F 1/08 148/554 |
| 2018/0040389 | A1 | 2/2018 | Matsunaga et al. | |
| 2018/0171437 | A1 * | 6/2018 | Matsunaga | H01B 5/02 |
| 2018/0187292 | A1 | 7/2018 | Matsunaga et al. | |
| 2018/0211741 | A1 | 7/2018 | Matsunaga et al. | |
| 2019/0048449 | A1 | 2/2019 | Matsunaga et al. | |
| 2021/0002743 | A1 * | 1/2021 | Matsunaga | H01B 5/02 |
| 2021/0017628 | A1 * | 1/2021 | Matsunaga | H01R 13/03 |

FOREIGN PATENT DOCUMENTS

| | | | |
|---|---|---|---|
| CN | 102108457 | A | 6/2011 |
| CN | 102177273 | A | 9/2011 |
| CN | 102203916 | A | 9/2011 |
| CN | 102753712 | A | 10/2012 |
| CN | 102892908 | A | 1/2013 |
| CN | 103502486 | A | 1/2014 |
| CN | 104822853 | A | 8/2015 |
| CN | 105369050 | A | 3/2016 |
| CN | 105392908 | A | 3/2016 |
| CN | 107208189 | A | 9/2017 |
| EP | 3348658 | A | 7/2018 |
| EP | 3438299 | A1 | 2/2019 |
| JP | 58-199835 | A | 11/1983 |
| JP | 61-284946 | A | 12/1986 |
| JP | 05-311283 | A | 11/1993 |
| JP | 07-018354 | A | 1/1995 |
| JP | 2007-056297 | A | 3/2007 |
| JP | 2009-007666 | A | 1/2009 |
| JP | 2009-228013 | A | 10/2009 |
| JP | 2010-126777 | A | 6/2010 |
| JP | 2011-174127 | A | 9/2011 |
| JP | 2011-241412 | A | 12/2011 |
| JP | 2012-007231 | A | 1/2012 |
| JP | 5045783 | B | 10/2012 |
| JP | 2013-095943 | A | 5/2013 |
| JP | 2013-100570 | A | 5/2013 |
| JP | 2013-104101 | A | 5/2013 |
| JP | 2013-204079 | A | 10/2013 |
| JP | 2013-253267 | A | 12/2013 |
| JP | 2014-025089 | A | 2/2014 |
| JP | 2014-047378 | A | 3/2014 |
| JP | 2014-114464 | A | 6/2014 |
| JP | 2015030863 | A | 2/2015 |
| JP | 2015-045083 | A | 3/2015 |
| JP | 2015-048503 | A | 3/2015 |
| JP | 2015-101773 | A | 6/2015 |
| JP | 5910790 | B | 4/2016 |
| JP | 2016047945 | A | 4/2016 |
| JP | 6156600 | B | 7/2017 |
| JP | 6187629 | B | 8/2017 |
| JP | 2017-179490 | A | 10/2017 |
| JP | 2017-179492 | A | 10/2017 |
| JP | 2017-179493 | A | 10/2017 |
| JP | 2017-179553 | A | 10/2017 |
| JP | 2017-186662 | A | 10/2017 |
| JP | 2017-186664 | A | 10/2017 |
| TW | 201339328 | A | 10/2013 |
| WO | WO-2003/076672 | A | 9/2003 |
| WO | WO-2005/028143 | A1 | 3/2005 |
| WO | WO-2012/169405 | A | 12/2012 |
| WO | WO-2013/062091 | A | 5/2013 |
| WO | WO-2013/069687 | A | 5/2013 |
| WO | WO-2013/073412 | A | 5/2013 |
| WO | WO-201 3/150627 | A1 | 10/2013 |
| WO | WO-2017/043559 | A1 | 3/2017 |
| WO | WO-2017/170733 | A1 | 10/2017 |

OTHER PUBLICATIONS

Extended European Search Report dated Nov. 8, 2019 for the corresponding European Patent Application No. 17775233.4.
International Search Report dated Nov. 8, 2016 for the related PCT Application No. PCT/JP2016/076456.
International Search Report dated Nov. 8, 2016 for the related PCT Application No. PCT/JP2016/076362.
International Search Report dated Nov. 8, 2016 for the related PCT Application No. PCT/JP2016/076376.
International Search Report dated Dec. 6, 2016 for the related PCT Application No. PCT/JP2016/076387.
Notice of Allowance dated May 9, 2017 for the related Japanese Patent Application No. 2016-575989.
Office Action dated Apr. 4, 2018 for the related Chinese Patent Application No. 201680008019.8.
David Chapman "High Conductivity Copper for Electrical Engineering", May 31, 1998 [Retrieved from the Internet on Jul. 2, 2018].
R. Sundberg et al. "The Cu—Mg—P system: precipitation phenomena and physical properties", *Metal Technology*, Dec. 31, 1979, pp. 230-234, vol. 6, No. 1.
Extended European Search Report dated Jul. 11, 2018 for the related European Patent Application No. 16844412.3.
Chinese Office Action dated Nov. 27, 2018 for the related Chinese Application No. 201680032061.3.
Chinese Office Action dated Dec. 27, 2018 for the related Chinese Application No. 201680008019.8.
David Chapman: "Coatings" In: "Copper for Busbars", May 31, 2014 (May 31, 2014), Copper Development Association, pp. 103-105.
Office Action dated Feb. 28, 2019 for the related European Patent Application No. 16844412.3.
European Search Report dated Mar. 7, 2019 for the related European Patent Application No. 16844420.6.
Maki Kazunari et al: "Solid-solution copper alloys with high strength and high electrical conductivity", Scripta Materialia, Elsevier, Amsterdam, NL, vol. 68, No. 10 Jan. 2, 2013 (Jan. 2, 2013), pp. 777-780.

(56) References Cited

OTHER PUBLICATIONS

Maki Kazunari et al: Supplementary information to "Solid-solution copper alloys with high strength and high electrical conductivity", Scripta Materialia, vol. 68, No. 10, Jan. 2, 2013 (Jan. 2, 2013), pp. 777-780.
Zhu Chengcheng et al: "Effect of ECAP combined cold working on mechanical properties and electrical conductivity of Conform-produced Cu—Mg alloys", Journal of Alloys and Compounds, vol. 582, Aug. 14, 2013 (Aug. 14, 2013), pp. 135-140.
ASM: "Casting of Copper and Copper Alloys" In: "Casting", Dec. 31, 2008 (Dec. 31, 2008), ASM International, pp. 1026-1048.
European Search Report dated Apr. 17, 2019 for the related European Patent Application No. 16844417.2.
European Search Report dated Apr. 18, 2019 for the related European Patent Application No. 16844438.8.
Jingpu Wang et al., "Cable Materials," *Mechanical Industry Press*, Nov. 1983, pp. 80-81.
Office Action dated Jun. 12, 2019 for the related Chinese Patent Application No. 201680008019.8.
U.S. Office Action dated Jul. 11, 2019 for the related U.S. Appl. No. 15/737,642.
U.S. Office Action dated Aug. 28, 2019 for the related U.S. Appl. No. 15/741,148.
International Search Report dated Jun. 27, 2017 for the corresponding PCT Application No. PCT/JP2017/012914.
Notice of Allowance dated Sep. 12, 2017 for the corresponding Japanese Patent Application No. 2017-063418.
Non-Final Office Action dated Jul. 11, 2019 for the related U.S. Appl. No. 15/737,642.
Non-Final Office Action dated Apr. 1, 2020 for the related U.S. Appl. No. 15/737,642.
Final Office Action dated Nov. 14, 2019 for the related U.S. Appl. No. 15/737,642.
Non-Final Office Action dated Sep. 5, 2018 for the related U.S. Appl. No. 15/543,664.
Nomura, "Technical Trends in High Performance Copper Alloy Strip for Connector and Kobe Steel's Development Strategy", *Kobe Steel Works Engineering Reports*, Apr. 2004, pp. 2-8, vol. 54 No. 1.
Hori, et al., "Intergranular (Grain boundary) precipitation in a Cu—Mg alloy", *Journal of the Japan Copper and Brass Research Association*, 1980, pp. 115-124, vol. 19.
International Search Report dated Jan. 27, 2015 for the corresponding PCT Application No. PCT/JP2014/078031.
Office Action dated Oct. 27, 2015 for the corresponding Japanese Patent No. 2013-256310.
Office Action dated Nov. 9, 2015 for the corresponding Taiwanese Patent No. 103138036.
J.R. Davis, edited, "ASM Speciality Handbook-Copper and its alloys", Aug. 2001, p. 15, *ASM International*, Materials Park, U.S.A.
E.G. West, "Copper and its alloys", 1982, pp. 129, *Ellis Horwood Limited*, Chichester, England.
Extended European Search Report dated Jul. 17, 2017 for the corresponding European Patent Application No. 14869335.1.
Office Action dated Apr. 14, 2017 for the corresponding Chinese Patent Application No. 201480065514.3.
Chinese Office Action dated May 10, 2021 for the related Chinese Patent Application No. 201980015759.8.
Kronberg et al., "Secondary Recrystallization in Copper" *Metals Transactions*, Aug. 1949, pp. 501-514, vol. 185.
D. G. Brandon, "The Structure of High-Angle Grain Boundaries", *Acta Metallurgica*, Nov. 1966, pp. 1479-1484, vol. 14.
International Search Report dated Jul. 2, 2019 for the corresponding PCT International Application No. PCT/JP2019/013552.
Japanese Office Action dated Nov. 19, 2019 for the corresponding Japanese Patent Application No. 2019-528783.
Non-Final Office Action dated Nov. 11, 2020 for the related U.S. Appl. No. 16/976,351.
Non-Final Office Action dated Nov. 18, 2020 for the related U.S. Appl. No. 16/976,351 (The copy of this reference was previously submitted on Feb. 18, 2021).
Extended European Search Report dated Nov. 19, 2019 for the related European Patent Application No. 17775267.2.
International Search Report dated Jun. 27, 2017 for the related PCT Application No. PCT/JP2017/012993.
Notice of Allowance dated Sep. 12, 2017 for the related Japanese Patent Application No. 2017-063258.
Chinese Office Action dated Aug. 28, 2019 for the related Chinese Patent Application No. 201780005496.3.
U.S. Office Action dated Mar. 16, 2021 for the related U.S. Appl. No. 16/076,257.
Korean Notice of Allowance dated Jun. 24, 2021 for the corresponding Korean Patent Application No. 10-2018-7021014.
European Search Report dated Oct. 21, 2021 for the related European Patent Application No. 19775874.1.

* cited by examiner

COPPER ALLOY FOR ELECTRONIC AND ELECTRICAL EQUIPMENT, COPPER ALLOY PLATE STRIP FOR ELECTRONIC AND ELECTRICAL EQUIPMENT, COMPONENT FOR ELECTRONIC AND ELECTRICAL EQUIPMENT, TERMINAL, BUSBAR, AND MOVABLE PIECE FOR RELAY

CROSS-REFERENCE TO RELATED PATENT APPLICATIONS

This application is a U.S. National Phase Application under 35 U.S.C. § 371 of International Patent Application No. PCT/JP2017/012914, filed Mar. 29, 2017, and claims the benefit of Japanese Patent Application No. 2016-069080, filed on Mar. 30, 2016 and Japanese Patent Application No. 2017-063418, filed on Mar. 28, 2017, all of which are incorporated herein by reference in their entirety. The International Application was published in Japanese on Oct. 5, 2017 as International Publication No. WO/2017/170699 under PCT Article 21(2).

FIELD OF THE INVENTION

The invention of the present application relates to a copper alloy for electronic and electrical equipment suitable for a component for electronic and electrical equipment, for example, a terminal such as a connector or a press fit, a movable piece for a relay, a lead frame, or a busbar, and a copper alloy plate strip for electronic and electrical equipment, a component for electronic and electrical equipment, a terminal, a busbar, and a movable piece for a relay formed of the copper alloy for electronic and electrical equipment.

BACKGROUND OF THE INVENTION

In the related art, as a component for electronic and electrical equipment, for example, a terminal such as a connector or a press fit, a movable piece for a relay, a lead frame, or a busbar, copper or a copper alloy with high conductivity has been used.

Here, along with miniaturization of electronic equipment, electrical equipment, or the like, miniaturization and reduction in thickness of a component for electronic and electrical equipment used for the electronic equipment, the electrical equipment, or the like have been attempted. Therefore, the material constituting the component for electronic and electrical equipment is required to have high strength or high bending workability. Further, a terminal such as a connector used in a high temperature environment such as an engine room of a vehicle is required to have stress relaxation resistance.

For example, a Cu—Mg-based alloy is suggested in Japanese Patent No. 5045783 and Japanese Unexamined Publication No. 2014-114464 as the material used for the terminal such as a connector or a press fit or the component for electronic and electrical equipment such as a movable piece for a relay, a lead frame, or a busbar.

Technical Problem

Here, in the Cu—Mg-based alloy described in Japanese Patent No. 5045783, since the content of Mg is large, the conductivity is insufficient, and thus it is difficult to use the alloy for applications requiring high conductivity.

Further, in the Cu—Mg-based alloy described in Japanese Unexamined Publication No. 2014-114464, since the content of Mg is in a range of 0.01 to 0.5 mass % and the content of P is in a range of 0.01 to 0.5 mass %, coarse compounds that significantly deteriorate cold workability and bending workability have not been considered, and thus the cold workability and the bending workability are insufficient.

In the above-described Cu—Mg-based alloy, the viscosity of a molten copper alloy is increased due to Mg. Accordingly, there is a problem in that the castability is degraded in a case where P is not added.

Recently, reduction in thickness of a component for electronic and electrical equipment, for example, a terminal such as a connector, a movable piece for a relay, or a lead frame which has been used for electronic equipment or electrical equipment has been attempted along with reduction in weight of electronic and electrical equipment. Therefore, in the terminal such as a connector, it is necessary to perform severe bend working in order to ensure the contact pressure. Accordingly, bending workability is required more than ever before.

The present invention has been made in consideration of the above-described circumstances, and an object thereof is to provide a copper alloy for electronic and electrical equipment, a copper alloy plate strip for electronic and electrical equipment, a component for electronic and electrical equipment, a terminal, a busbar, and a movable piece for a relay with high conductivity and bending workability.

SUMMARY OF THE INVENTION

Solution to Problem

According to an aspect of the invention of the present application, in order to solve the above-described problems, there is provided a copper alloy for electronic and electrical equipment (hereinafter, referred to as a "copper alloy for electronic and electrical equipment of the present disclosure") including: 0.15 mass % or greater and less than 0.35 mass % of Mg; 0.0005 mass % or greater and less than 0.01 mass % of P; and a remainder which is formed of Cu and unavoidable impurities, in which a conductivity is greater than 75% IACS, and an average number of compounds containing Mg and P with a particle diameter of 0.1 μm or greater is 0.5 pieces/$\mu m^2$ or less in observation using a scanning electron microscope.

According to the copper alloy for electronic and electrical equipment with the above-described configuration, the content of Mg is 0.15 mass % or greater and less than 0.35 mass %. Therefore, by solid-dissolving Mg in a mother phase of copper, the strength and the stress relaxation resistance can be improved without significantly degrading the conductivity. Specifically, since the conductivity is greater than 75% IACS, the copper alloy can be used for applications requiring high conductivity. Further, since the content of P is 0.0005 mass % or greater and less than 0.01 mass %, the viscosity of a molten copper alloy containing Mg can be decreased and the castability can be improved.

Moreover, since the average number of compounds containing Mg and P with a particle diameter of 0.1 μm or greater is 0.5 pieces/$\mu m^2$ or less in observation using a scanning electron microscope, the compounds containing coarse Mg and P serving as a starting point of cracking are not largely dispersed in a mother phase and thus the bending workability is improved. Accordingly, it is possible to form a component for electronic and electrical equipment, for example, a terminal such as a connector, a movable piece for a relay, or a lead frame in a complicated shape.

In the copper alloy for electronic and electrical equipment of the present disclosure, it is preferable that a content [Mg] (mass %) of Mg and a content [P] (mass %) of P satisfy a relational expression of $[Mg]+20\times[P]<0.5$.

In this case, generation of coarse compounds containing Mg and P can be suppressed, and degradation of the cold workability and the bending workability can be suppressed.

In the copper alloy for electronic and electrical equipment of the present disclosure, it is preferable that a content [Mg] (mass %) of Mg and a content [P] (mass %) of P satisfy a relational expression of $[Mg]/[P]\leq 400$.

In this case, the castability can be reliably improved by specifying the ratio between the content of Mg that decreases the castability and the content of P that improves the castability, as described above.

In the copper alloy for electronic and electrical equipment of the present disclosure, it is preferable that a 0.2% proof stress measured at the time of a tensile test performed in a direction orthogonal to a rolling direction is 300 MPa or greater.

In this case, since the 0.2% proof stress measured at the time of the tensile test performed in a direction orthogonal to a rolling direction is specified as described above, the copper alloy is not easily deformed and is particularly suitable as a copper alloy constituting a component for electronic and electrical equipment, for example, a terminal such as a connector or a press fit, a movable piece for a relay, a lead frame, or a busbar.

Further, in the copper alloy for electronic and electrical equipment of the present disclosure, it is preferable that a residual stress ratio is 50% or greater under conditions of 150° C. for 1000 hours.

In this case, since the stress relaxation rate is specified as described above, permanent deformation can be suppressed to the minimum when used in a high temperature environment, and a decrease in contact pressure of a connector terminal or the like can be prevented. Therefore, the alloy can be applied as a material of a component for electronic equipment to be used in a high temperature environment such as an engine room.

A copper alloy plate strip for electronic and electrical equipment according to another aspect of the invention of the present application (hereinafter, referred to as a "copper alloy plate strip for electronic and electrical equipment") includes the copper alloy for electronic and electrical equipment.

According to the copper alloy plate strip for electronic and electrical equipment with such a configuration, since the copper alloy plate strip is formed of the copper alloy for electronic and electrical equipment, the conductivity, the strength, the bending workability, and the stress relaxation resistance are excellent. Accordingly, the copper alloy plate strip is particularly suitable as a material of a component for electronic and electrical equipment, for example, a terminal such as a connector or a press fit, a movable piece for a relay, a lead frame, or a busbar.

Further, the copper alloy plate strip for electronic and electrical equipment of the present disclosure includes a plate material and a strip formed by winding the plate material in a coil shape.

In the copper alloy plate strip for electronic and electrical equipment of the present disclosure, it is preferable that the copper alloy plate strip includes a Sn plating layer or a Ag plating layer on a surface of the copper alloy plate strip.

In this case, since the surface of the copper alloy plate strip has a Sn plating layer or a Ag plating layer, the copper alloy plate strip is particularly suitable as a material of a component for electronic and electrical equipment, for example, a terminal such as a connector or a press fit, a movable piece for a relay, a lead frame, or a busbar. In the present disclosure, the "Sn plating" includes pure Sn plating or Sn alloy plating and the "Ag plating" includes pure Ag plating or Ag alloy plating.

A component for electronic and electrical equipment according to another aspect of the invention of the present application (hereinafter, referred to as a "component for electronic and electrical equipment of the present disclosure") includes the copper alloy plate strip for electronic and electrical equipment described above. Further, as the component for electronic and electrical equipment of the present disclosure, a terminal such as a connector or a press fit, a movable piece for a relay, a lead frame, and a busbar are exemplified.

Since the component for electronic and electrical equipment with such a configuration is produced using the copper alloy plate strip for electronic and electrical equipment described above, excellent characteristics can be exhibited even in a case of miniaturization and reduction in thickness.

Further, in the component for electronic and electrical equipment of the present disclosure, the component includes a Sn plating layer or a Ag plating layer on a surface of the component. Further, the Sn plating layer and the Ag plating layer may be formed on the copper alloy plate strip for electronic and electrical equipment in advance or may be formed after the component for electronic and electrical equipment is formed.

A terminal according to another aspect of the invention of the present application (hereinafter, referred to as a "terminal of the present disclosure") includes the copper alloy plate strip for electronic and electrical equipment described above.

Since the terminal with such a configuration is produced using the copper alloy plate strip for electronic and electrical equipment described above, excellent characteristics can be exhibited even in a case of miniaturization and reduction in thickness.

Further, in the terminal of the present disclosure, the terminal includes a Sn plating layer or a Ag plating layer on a surface of the terminal. Further, the Sn plating layer and the Ag plating layer may be formed on the copper alloy plate strip for electronic and electrical equipment in advance or may be formed after the terminal is formed.

A busbar according to another aspect of the invention of the present application (hereinafter, referred to as a "busbar of the present disclosure") includes the copper alloy plate strip for electronic and electrical equipment described above.

Since the busbar with such a configuration is produced using the copper alloy plate strip for electronic and electrical equipment described above, excellent characteristics can be exhibited even in a case of miniaturization and reduction in thickness.

Further, in the busbar of the present disclosure, the busbar includes a Sn plating layer or a Ag plating layer on a surface of the busbar. Further, the Sn plating layer and the Ag plating layer may be formed on the copper alloy plate strip for electronic and electrical equipment in advance or may be formed after the busbar is formed.

A movable piece for a relay according to another aspect of the invention of the present application (hereinafter, referred to as a "movable piece for a relay of the present disclosure") includes the copper alloy plate strip for electronic and electrical equipment described above.

Since the movable piece for a relay with such a configuration is produced using the copper alloy plate strip for electronic and electrical equipment described above, excellent characteristics can be exhibited even in a case of miniaturization and reduction in thickness.

Further, in the movable piece for a relay of the present disclosure, the movable piece includes a Sn plating layer or a Ag plating layer on a surface of the movable piece. Further, the Sn plating layer and the Ag plating layer may be formed on the copper alloy plate strip for electronic and electrical equipment in advance or may be formed after the movable piece for a relay is formed.

Advantageous Effects of Invention

According to the present disclosure, it is possible to provide a copper alloy for electronic and electrical equipment, a copper alloy plate strip for electronic and electrical equipment, a component for electronic and electrical equipment, a terminal, a busbar, and a movable piece for a relay with excellent conductivity and bending workability.

DETAILED DESCRIPTION OF THE INVENTION

Description of Embodiments

Figure 1:
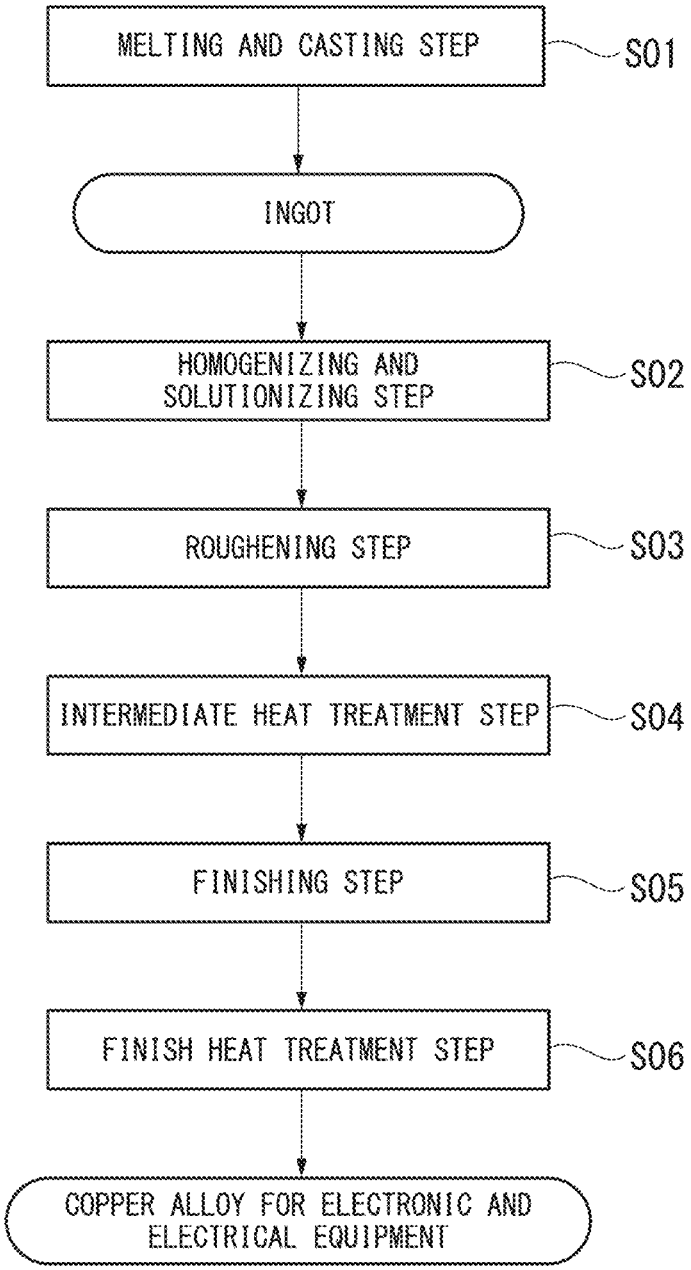
FIG. 1 is a flow chart showing a method of producing a copper alloy for electronic and electrical equipment according to the present embodiment.

Hereinafter, a copper alloy for electronic and electrical equipment according to an embodiment of the present disclosure will be described.

The copper alloy for electronic and electrical equipment according to the present embodiment has a composition of 0.15 mass % or greater and less than 0.35 mass % of Mg; 0.0005 mass % or greater and less than 0.01 mass % of P; and the remainder formed of Cu and unavoidable impurities.

Further, in the copper alloy for electronic and electrical equipment according to the present embodiment, the conductivity is greater than 75% IACS.

Further, in the copper alloy for electronic and electrical equipment according to the present embodiment, the average number of compounds containing Mg and P with a particle diameter of 0.1 μm or greater is 0.5 pieces/$\mu m^2$ or less in observation using a scanning electron microscope.

In the copper alloy for electronic and electrical equipment according to the present embodiment, the content [Mg] (mass %) of Mg and the content [P] (mass %) of P satisfy a relational expression of $[Mg]+20\times[P]<0.5$.

Further, in the present embodiment, the content [Mg] (mass %) of Mg and the content [P] (mass %) of P satisfy a relational expression of $[Mg]/[P]\leq 400$.

Further, in the copper alloy for electronic and electrical equipment according to the present embodiment, the 0.2% proof stress measured at the time of a tensile test performed in a direction orthogonal to a rolling direction is 300 MPa or greater. In other words, in the present embodiment, a rolled material of the copper alloy for electronic and electrical equipment is used, and the 0.2% proof stress measured at the time of the tensile test performed in a direction orthogonal to the rolling direction in the final step of rolling is specified as described above.

Further, in the copper alloy for electronic and electrical equipment according to the present embodiment, the residual stress ratio is 50% or greater under conditions of 150° C. for 1000 hours.

Here, the reasons for specifying the component composition, the compound, and various characteristics as described above will be described.

(Mg: 0.15 Mass % or Greater and Less than 0.35 Mass %)

Mg is an element having a function of improving the strength and the stress relaxation resistance without significantly degrading the conductivity through solid solution in a mother phase of a copper alloy.

Here, in a case where the content of Mg is less than 0.15 mass %, there is a concern that the effects of the function are not sufficiently achieved. Further, in a case where the content of Mg is 0.35 mass % or greater, there is a concern that the conductivity is significantly degraded, the viscosity of a molten copper alloy is increased, and the castability is degraded.

As described above, in the present embodiment, the content of Mg is set to be 0.15 mass % or greater and less than 0.35 mass %.

In order to improve the strength and the stress relaxation resistance, the lower limit of the content of Mg is set to preferably 0.16 mass % or greater and more preferably 0.17 mass % or greater. Further, in order to reliably suppress degradation of the conductivity and degradation of the castability, the upper limit of the content of Mg is set to preferably 0.30 mass % or less and more preferably 0.28 mass % or less.

(P: 0.0005 Mass % or Greater and Less than 0.01 Mass %)

P is an element having a function of improving the castability.

Here, in a case where the content of P is less than 0.0005 mass %, there is a concern that the effects of the function are not fully achieved. Further, in a case where the content of P is 0.01 mass % or greater, there is a concern that, since coarse compounds containing Mg and P with a particle diameter of 0.1 μm or greater are likely to be generated, the compounds serve as a starting point of fracture and cracking occurs during cold working or bend working.

As described above, in the present embodiment, the content of P is set to be 0.0005 mass % or greater and less than 0.01 mass %.

In order to reliably improve the castability, the lower limit of the content of P is set to preferably 0.0007 mass % and more preferably 0.001 mass %. Further, in order to reliably suppress generation of coarse compounds, the upper limit of the content of P is set to preferably less than 0.009 mass %, more preferably less than 0.008 mass %, still more preferably 0.0075 mass % or less, and even still more preferably 0.0050 mass % or less.

($[Mg]+20\times[P]<0.5$)

As described above, coarse compounds containing Mg and P are generated due to the coexistence of Mg and P.

Here, in a case where the content [Mg] of Mg and the content [P] of P are set in terms of mass ratio, since the total amount of Mg and P is large and coarse compounds containing Mg and P coarsen and are distributed at a high density, cracking may easily occur during cold working or bend working in a case where [Mg]+20×[P] is 0.5 or greater.

As described above, in the present embodiment, [Mg]+20×[P] is set to less than 0.5. Further, in order to reliably suppress coarsening and densification of the compounds and to suppress occurrence of cracking during the cold working and the bend working, [Mg]+20×[P] is set to preferably less than 0.48 and more preferably less than 0.46. Further, [Mg]+20×[P] is set to still more preferably less than 0.44.

([Mg]/[P]≤400)

Since Mg is an element having a function of increasing the viscosity of the molten copper alloy and decreasing the castability, it is necessary to optimize the ratio between the content of Mg and the content of P in order to reliably improve the castability.

Here, in a case where the content [Mg] of Mg and the content [P] of P are set in terms of mass ratio, since the content of Mg with respect to the content of P is increased, the effect of improving the castability through addition of P may be reduced in a case where [Mg]/[P] is greater than 400.

As described above, in the present embodiment, [Mg]/[P] is set to 400 or less. In order to further improve the castability, [Mg]/[P] is set to preferably 350 or less and more preferably 300 or less.

Further, in a case where [Mg]/[P] is extremely small, since Mg is consumed as a coarse compound, the effect from solid solution of Mg may not be obtained. In order to suppress generation of coarse compounds containing Mg and P and to reliably improve the proof stress due to solid solution of Mg and the stress relaxation resistance, the lower limit of [Mg]/[P] is set to preferably greater than 20 and more preferably greater than 25.

(Unavoidable Impurities: 0.1 Mass % or Less)

Examples of other unavoidable impurities include Ag, B, Ca, Sr, Ba, Sc, Y, rare earth elements, Ti, Zr, Hf, V, Nb, Ta, Cr, Mo, W, Mn, Re, Fe, Ru, Os, Co, Se, Te, Rh, Ir, Ni, Pd, Pt, Au, Zn, Cd, Hg, Al, Ga, In, Ge, Sn, As, Sb, Tl, Pb, Bi, Be, N, C, Si, Li, H, O, and S. Since these unavoidable impurities have a function of decreasing the conductivity, the total amount thereof is set to 0.1 mass % or less.

Further, from the viewpoint that Ag, Zn, and Sn are easily mixed into copper so that the conductivity is decreased, it is preferable that the total amount of the unavoidable elements is set to less than 500 mass ppm. Particularly from the viewpoint that Sn greatly decreases the conductivity, it is preferable that the content of Sn is set to less than 50 mass ppm.

Further, from the viewpoint that Si, Cr, Ti, Zr, Fe, and Co greatly decrease particularly the conductivity and the bending workability deteriorates due to the formation of compounds, it is preferable that the total amount of these elements is set to less than 500 mass ppm.

(Compounds Containing Mg and P)

In the copper alloy for electronic and electrical equipment according to the present embodiment, as the result of observation using a scanning electron microscope, the average number of compounds containing Mg and P with a particle diameter of 0.1 μm or greater is 0.5 pieces/$\mu m^2$ or less. In a case where a large amount of compounds with a large size are present, these compounds serve as a starting point of cracking and thus the bending workability significantly deteriorates.

As the result of investigation of the structure, in a case where the average number of compounds containing Mg and P with a particle diameter of 0.1 μm or greater is 0.5 pieces/$\mu m^2$ or less, that is, in a case where compounds containing Mg and P are not present or the amount of the compounds is small, excellent bending workability is obtained.

Further, in order to reliably exert the effects of the functions described above, it is more preferable that the number of compounds containing Mg and P with a particle diameter of 0.05 μm or greater is 0.5 pieces/$\mu m^2$ or less in the alloy.

The average number of compounds containing Mg and P is obtained by observing 10 visual fields at a magnification of 50000 times and a visual field of approximately 4.8 $\mu m^2$ using a field emission type scanning electron microscope and calculating the average value thereof.

Further, the particle diameter of the compound containing Mg and P is set as an average value of the long diameter (the length of the longest straight line which can be drawn in a grain under a condition in which the line does not come into contact with the grain boundary in the middle of drawing) of the compound and the short diameter (the length of the longest straight line which can be drawn under a condition in which the line does not come into contact with the grain boundary in the middle of drawing in a direction orthogonal to the long diameter) of the compound. The average number (number density) of the compounds containing Mg and P with a particle diameter of 0.1 μm or greater per unit area can be controlled mainly by the casting rate, the intermediate heat treatment temperature, and the heat treatment time. The average number (number density) of the compounds per unit area can be reduced by increasing the casting rate and setting the intermediate heat treatment to be carried out at a high temperature for a short time. The casting rate and the intermediate heat treatment conditions are selected as appropriate.

(Conductivity: Greater than 75% IACS)

In the copper alloy for electronic and electrical equipment according to the present embodiment, by setting the conductivity to greater than 75% IACS, the alloy can be satisfactorily used as a component for electronic and electrical equipment, for example, a terminal such as a connector or a press fit, a movable piece for a relay, a lead frame, or a busbar.

In addition, the conductivity is set to preferably greater than 76% IACS, more preferably greater than 77% IACS, still more preferably greater than 78% IACS, and even still more preferably greater than 80% IACS.

(0.2% Proof Stress: 300 MPa or Greater)

In the copper alloy for electronic and electrical equipment according to the present embodiment, by setting the 0.2% proof stress to 300 MPa or greater, the alloy becomes particularly suitable as a material of a component for electronic and electrical equipment, for example, a terminal such as a connector or a press fit, a movable piece for a relay, a lead frame, or a busbar. Further, in the present embodiment, the 0.2% proof stress measured at the time of the tensile test performed in a direction orthogonal to the rolling direction is set to 300 MPa or greater.

Here, the 0.2% proof stress described above is set to preferably 325 MPa or greater and more preferably 350 MPa or greater.

(Residual Stress Ratio: 50% or Greater)

In the copper alloy for electronic equipment according to the present embodiment, the residual stress ratio is set to 50% or greater under conditions of 150° C. for 1000 hours as described above.

In a case where the residual stress ratio under the above-described conditions is high, permanent deformation can be suppressed to the minimum when used in a high temperature environment, and a decrease in contact pressure can be prevented. Therefore, the copper alloy for electronic equipment according to the present embodiment can be applied as a terminal to be used in a high temperature environment such as the periphery of an engine room of a vehicle. In the present embodiment, the residual stress ratio measured at the time of a stress relaxation test performed in a direction orthogonal to the rolling direction is set to 50% or greater under conditions of 150° C. for 1000 hours.

Here, the above-described residual stress ratio is set to preferably 60% or greater under conditions of 150° C. for 1000 hours and more preferably 70% or greater under conditions of 150° C. for 1000 hours.

Next, a method of producing the copper alloy for electronic and electrical equipment according to the present embodiment with such a configuration will be described with reference to the flow chart of FIG. 1.

(Melting and Casting Step S01)

First, the above-described elements are added to molten copper obtained by melting the copper raw material to adjust components, thereby producing a molten copper alloy. In terms of the form of each element to be added, a single element, a mother alloy, or the like can be used. In addition, raw materials containing the above-described elements may be melted together with the copper raw material. Further, a recycled material or a scrap material of the present alloy may be used. Here, as the molten copper, so-called 4 NCu having a purity of 99.99 mass % or greater or so-called 5 NCu having a purity of 99.999 mass % or greater is preferably used. In the melting step, in order to suppress oxidation of Mg and reduce the hydrogen concentration, it is preferable that the holding time at the time of melting is set to the minimum by performing atmosphere melting using an inert gas atmosphere (for example, Ar gas) in which the vapor pressure of $H_2O$ is low.

Further, the molten copper alloy in which the components have been adjusted is injected into a mold to produce an ingot. In consideration of mass production, it is preferable to use a continuous casting method or a semi-continuous casting method.

Since a compound containing Mg and P is formed as a crystallized material at the time of solidification of molten metal, the size of the compound containing Mg and P can be set to be finer by increasing the solidification rate. Accordingly, the cooling rate of the molten metal is set to preferably 0.5° C./sec or greater, more preferably 1° C./sec or greater, and most preferably 15° C./sec or greater.

(Homogenizing and Solutionizing Step S02)

Next, a heat treatment is performed for homogenization and solutionization of the obtained ingot. Intermetallic compounds and the like containing Cu and Mg, as the main components, generated due to concentration through the segregation of Mg in the process of solidification are present in the ingot. Mg is allowed to be homogeneously diffused or solid-dissolved in a mother phase in the ingot by performing the heat treatment of heating the ingot to a temperature range of 300° C. to 900° C. for the purpose of eliminating or reducing the segregation and the intermetallic compounds. In addition, it is preferable that this homogenizing and solutionizing step S02 is performed in a non-oxidizing or reducing atmosphere.

Here, in a case where the heating temperature is lower than 300° C., the solutionization becomes incomplete, and thus a large amount of intermetallic compounds containing, as the main components, Cu and Mg in the mother phase may remain. Further, in a case where the heating temperature is higher than 900° C., part of the copper material becomes a liquid phase, and thus the structure or the surface state may become non-uniform. Therefore, the heating temperature is set to be in a range of 300° C. to 900° C.

Further, hot working may be performed after the above-described homogenizing and solutionizing step S02 for the purpose of increasing efficiency of roughening and homogenizing the structure described below. Further, the working method is not particularly limited, and examples of the method which can be used include rolling, drawing, extruding, groove rolling, forging, and pressing. It is preferable that the hot working temperature be in a range of 300° C. to 900° C.

(Roughening Step S03)

In order to process in a predetermined shape, roughening is performed. Further, the temperature condition in this roughening step S03 is not particularly limited, but is preferably in a range of −200° C. to 200° C., which is the range for cold or warm working, and particularly preferably room temperature in order to suppress re-crystallization or improve dimensional accuracy. The working ratio (rolling ratio) is preferably 20% or greater and more preferably 30% or greater. Further, the working method is not particularly limited, and examples of the method which can be used include rolling, drawing, extruding, groove rolling, forging, and pressing.

(Intermediate Heat Treatment Step S04)

In order for thorough solutionization and improvement of the recrystallized structure and workability, a heat treatment is performed for the softening after the roughening step S03. A method of the heat treatment is not particularly limited. However, since the heat treatment step needs to be performed at a high temperature for a short time in order not to increase the particle diameter of the compound formed due to crystallization or the like, the heat treatment is performed preferably in a holding temperature range of 400° C. to 900° C. for a holding time of 5 seconds to 1 hour and more preferably in a holding temperature range of 500° C. to 900° C. for a holding time of 5 seconds to 30 minutes. Further, the heat treatment is performed in a non-oxidizing atmosphere or a reducing atmosphere.

Further, the cooling method after the working is not particularly limited, but it is preferable that a method in which the cooling rate for water quenching or the like is set to 200° C./min or greater is employed.

Further, the roughening step S03 and the intermediate heat treatment step S04 may be repeatedly performed.

(Finishing Step 505)

In order to process the copper material after the intermediate heat treatment step S04 in a predetermined shape, finishing is performed. Further, the temperature condition in this finishing step S05 is not particularly limited, but is set to be preferably in a range of −200° C. to 200° C., which is the range for cold or warm working, and particularly preferably room temperature in order to suppress re-crystallization or softening. In addition, the working ratio is appropriately selected such that the shape of the copper material approximates the final shape, but it is preferable that the working ratio is set to 20% or greater from the viewpoint of improving the strength through work hardening in the finishing step S05. In a case of further improving the strength, the working ratio is set to more preferably 30% or greater, still more preferably 40% or greater, and most preferably 60% or greater. Further, since the bending workability deteriorates due to an increase of the working ratio, it is preferable that the working ratio is set to 99% or less.

(Finish Heat Treatment Step S06)

Next, in order to improve the stress relaxation resistance, carry out low-temperature annealing and hardening, or remove residual strain, a finish heat treatment is performed on the plastic working material obtained from the finishing step S05.

The heat treatment temperature is set to be preferably in a range of 100° C. to 800° C. and more preferably in a range of 200° C. to 700° C. Further, in this finish heat treatment step S06, it is necessary to set heat treatment conditions (the temperature, the time, and the cooling rate) for the purpose of avoiding a significant decrease of the strength due to re-crystallization. For example, it is preferable that the material is held at 300° C. for 1 second to 120 seconds. It is preferable that this heat treatment is performed in a non-oxidizing or reducing atmosphere.

A method of performing the heat treatment is not particularly limited, but it is preferable that the heat treatment is performed using a continuous annealing furnace for a short period of time from the viewpoint of the effects of reducing the production cost.

Further, the finishing step S05 and the finish heat treatment step S06 may be repeatedly performed.

In the above-described manner, a copper alloy plate strip for electronic and electrical equipment (a plate material or a strip obtained by forming a plate material in a coil shape) according to the present embodiment is produced. Further, the plate thickness of the copper alloy plate strip for electronic and electrical equipment is greater than 0.05 mm and 3.0 mm or less, and preferably greater than 0.1 mm and less than 3.0 mm. In a case where the plate thickness of the copper alloy plate strip for electronic and electrical equipment is 0.05 mm or less, the copper alloy plate strip is not suitable for use as a conductor in high current applications. In a case where the plate thickness is greater than 3.0 mm, it is difficult to carry out press punching.

Here, the copper alloy plate strip for electronic and electrical equipment according to the present embodiment may be used as a component for electronic and electrical equipment as it is, but a Sn plating layer or a Ag plating layer having a film thickness of 0.1 to 100 μm may be formed on one or both plate surfaces. At this time, it is preferable that the plate thickness of the copper alloy plate strip for electronic and electrical equipment is set to 10 to 1000 times the thickness of the plating layer.

Using the copper alloy for electronic and electrical equipment (the copper alloy plate strip for electronic and electrical equipment) according to the present embodiment as a material, for example, a component for electronic and electrical equipment, for example, a terminal such as a connector or a press fit, a movable piece for a relay, a lead frame, or a busbar is formed by performing punching or bending on the material.

According to the copper alloy for electronic and electrical equipment of the present embodiment with the above-described configuration, the content of Mg is 0.15 mass % or greater and less than 0.35 mass %. Therefore, by solid-dissolving Mg in a mother phase of copper, the strength and the stress relaxation resistance can be improved without significantly degrading the conductivity. Further, since the content of P is 0.0005 mass % or greater and less than 0.01 mass %, the viscosity of the molten copper alloy containing Mg can be decreased so that the castability can be improved.

Further, in the copper alloy for electronic and electrical equipment according to the present embodiment, since the conductivity is greater than 75% IACS, the copper alloy can be used for applications requiring high conductivity.

In the copper alloy for electronic and electrical equipment according to the present embodiment, since the average number of compounds containing Mg and P with a particle diameter of 0.1 μm or greater is 0.5 pieces/$\mu m^2$ or less in observation using a scanning electron microscope, the compounds containing coarse Mg and P serving as a starting point of cracking are not largely dispersed in a mother phase and thus the bending workability is improved. Accordingly, it is possible to form a component for electronic and electrical equipment, for example, a terminal such as a connector, a movable piece for a relay, or a lead frame in a complicated shape.

Further, in the copper alloy for electronic and electrical equipment according to the present embodiment, since the content [Mg] (mass %) of Mg and the content [P] (mass %) of P satisfy a relational expression of $[Mg]+20\times[P]<0.5$, generation of a coarse compounds containing Mg and P can be suppressed so that degradation of the cold workability and the bending workability can be suppressed.

In the copper alloy for electronic and electrical equipment according to the present embodiment, since the content [Mg] (mass %) of Mg and the content [P] (mass %) of P satisfy a relational expression of $[Mg]/[P]\leq 400$, the ratio between the content of Mg that degrades the castability and the content of P that improves the castability is optimized, and the castability can be reliably improved due to the effects of addition of P.

In the copper alloy for electronic and electrical equipment according to the present embodiment, since the 0.2% proof stress is 300 MPa or greater and the residual stress ratio is 50% or greater under conditions of 150° C. for 1000 hours, the strength and the stress relaxation resistance are excellent. Therefore, the copper alloy is particularly suitable as a material of a component for electronic and electrical equipment, for example, a terminal such as a connector or a press fit, a movable piece for a relay, a lead frame, or a busbar.

Since the copper alloy plate strip for electronic and electrical equipment according to the present embodiment is formed of the copper alloy for electronic and electrical equipment described above, a component for electronic and electrical equipment, for example, a terminal such as a connector or a press fit, a movable piece for a relay, a lead frame, or a busbar can be produced by performing bending working or the like on this copper alloy plate strip for electronic and electrical equipment.

Further, in a case where a Sn plating layer or a Ag plating layer is formed on the surface of the copper alloy plate strip, the plate strip is particularly suitable as a material of a component for electronic and electrical equipment, for example, a terminal such as a connector or a press fit, a movable piece for a relay, a lead frame, or a busbar.

Further, since the component for electronic and electrical equipment (a terminal such as a connector or a press fit, a movable piece for a relay, a lead frame, or a busbar) according to the present embodiment is formed of the copper alloy for electronic and electrical equipment described above, excellent characteristics can be exhibited even in a case of miniaturization and reduction in thickness.

Hereinbefore, the copper alloy for electronic and electrical equipment, the copper alloy plate strip for electronic and electrical equipment, and the component for electronic and electrical equipment (such as a terminal or a busbar) according to the embodiment of the present disclosure have been described, but the present disclosure is not limited thereto and can be appropriately changed within the range not departing from the technical ideas of the invention.

For example, in the above-described embodiment, the example of the method of producing the copper alloy for electronic and electrical equipment has been described, but the method of producing the copper alloy for electronic and electrical equipment is not limited to the description of the embodiment, and the copper alloy may be produced by appropriately selecting a production method of the related art.

EXAMPLES

Hereinafter, results of a verification test conducted to verify the effects of the present disclosure will be described.

A copper raw material formed of oxygen-free copper (ASTM B152 C10100) having a purity of 99.99 mass % or greater was prepared, a high-purity graphite crucible was charged with this material, and the material was high-frequency-melted in an atmosphere furnace in an Ar gas atmosphere. Various elements were added to the obtained molten copper to prepare the component composition listed in Table 1, and the composition was smelted in a mold to produce an ingot. Further, a heat insulating material (iso-wool) mold was used in Examples 2, 19, and 20 of the present invention, a carbon mold was used in Examples 21 and 22 of the present invention, a copper alloy mold having a water cooling function was used in Examples 1, 3 to 18, 23 to 34 of the present invention and Comparative Examples 1 to 3, and an iron mold provided with a heater having a heating function was used in Comparative Examples 4 and 5, as a casting mold. Further, the size of an ingot was set to have a thickness of approximately 100 mm, a width of approximately 150 mm, and a length of approximately 300 mm.

The vicinity of the casting surface of this ingot was chamfered such that the plate thickness of the final product was set to 0.5 mm, the ingot was cut out, and the size thereof was adjusted.

This block was heated for 4 hours under the temperature conditions listed in Table 2 in an Ar gas atmosphere and was subjected to a homogenizing and solutionizing treatment.

Thereafter, rough rolling was performed under the conditions listed in Table 2, and a heat treatment was performed under the temperature conditions listed in Table 2 using a salt bath.

The copper material which had been subjected to the heat treatment was appropriately cut to have a shape suitable as the final shape and surface grinding was performed in order to remove an oxide film. Next, finish rolling (finishing) was performed at room temperature and a rolling ratio listed in Table 2 to produce a thin plate having a thickness of 0.5 mm, a width of approximately 150 mm, and a length of 200 mm.

Further, the obtained plate was subjected to a finish heat treatment in an Ar atmosphere under the conditions listed in Table 2 after the finish rolling (finishing). Thereafter, water quenching was performed, thereby preparing a thin plate for evaluating characteristics.

(Castability)

The presence of surface roughening during the above-described casting was observed for evaluation of the castability. A case where surface roughening was not visually found at all or hardly found was evaluated as A, a case where small surface roughing with a depth of less than 1 mm was generated was evaluated as B, and a case where surface roughening with a depth of 1 mm or greater and less than 2 mm was generated was evaluated as C. Further, a case where surface roughening with a depth of 2 mm or greater was generated was evaluated as D, and the evaluation was stopped in this case. The evaluation results are listed in Table 3.

The depth of the surface roughening indicates the depth of surface roughening formed toward the central portion from an end portion of an ingot.

(Observation of Compound)

The rolled surface of each sample was subjected to mirror surface polishing and ion etching. In order to verify compounds containing Mg and P, a visual field (approximately 120 $\mu m^2$/visual field) at a magnification of 10000 was observed using a field emission type scanning electron microscope (FE-SEM).

Figure 2A:
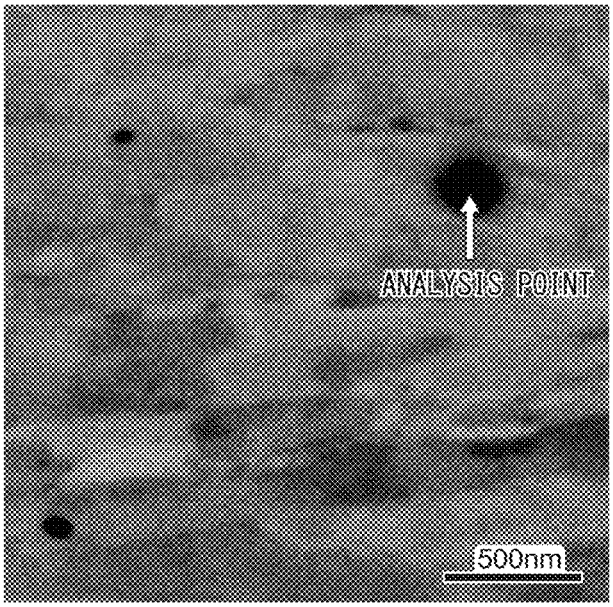
FIG. 2A is a photograph showing an example of the results obtained by observing a compound in the present example.
Figure 2B:
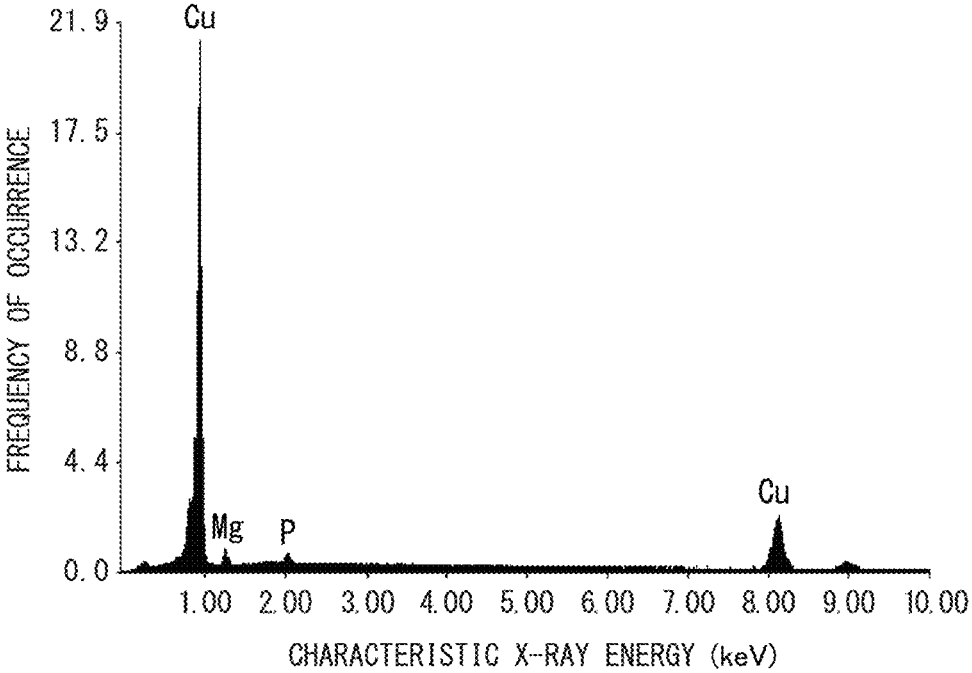
FIG. 2B describes EDX analysis results showing an example of the results obtained by observing the compound in the present example.

Next, in order to investigate the density (piece/$\mu m^2$) of compounds containing Mg and P, a visual field (approximately 120 $\mu m^2$/visual field) at a magnification of 10000 was selected, and 10 visual fields (approximately 4.8 $\mu m^2$/visual field) continued at a magnification of 50000 were imaged in the region. The particle diameter of the intermetallic compound was set as an average value of the long diameter (the length of the longest straight line which can be drawn in a grain under a condition in which the line does not come into contact with the grain boundary in the middle of drawing) of the intermetallic compound and the short diameter (the length of the longest straight line which can be drawn under a condition in which the line does not come into contact with the grain boundary in the middle of drawing in a direction orthogonal to the long diameter) of the intermetallic compound. The density (piece/$\mu m^2$) of compounds containing Mg and P with a particle diameter of 0.1 μm or greater and compounds containing Mg and P with a particle diameter of 0.05 μm or greater was measured. An example of the results obtained from observation of compounds is shown in FIGS. 2A and 2B.

(Mechanical Characteristics)

No. 13B test pieces specified in JIS Z 2241 were collected from each strip for evaluating characteristics and the 0.2% proof stress was measured according to the offset method in JIS Z 2241. Further, the test pieces were collected in a direction orthogonal to the rolling direction. The evaluation results are listed in Table 3.

(Conductivity)

Test pieces having a width of 10 mm and a length of 150 mm were collected from each strip for evaluating characteristics and the electric resistance was measured according to a 4 terminal method. Further, the dimension of each test piece was measured using a micrometer and the volume of the test piece was calculated. In addition, the conductivity was calculated from the measured electric resistance value and volume. Further, the test pieces were collected such that the longitudinal directions thereof were perpendicular to the rolling direction of each strip for evaluating characteristics. The evaluation results are listed in Table 3.

(Stress Relaxation Resistance)

A stress relaxation resistance test was carried out by loading stress according to a method in conformity with a cantilever screw type in Japan Elongated Copper Association Technical Standard JCBA-T309:2004 and measuring the residual stress ratio after storage at a temperature of 150° C. for 1000 hours. The evaluation results are listed in Table 3.

According to the test method, test pieces (width of 10 mm) were collected in a direction orthogonal to the rolling direction from each strip for evaluating characteristics, the initial deflection displacement was set to 2 mm such that the maximum surface stress of each test piece was 80% of the proof stress, and the span length was adjusted. The maximum surface stress was determined according to the following equation.

$$\text{Maximum surface stress (MPa)}=1.5\ Et\delta_0/L_s^2$$

Here, other conditions are as follows.

E: Young's modulus (MPa)

t: thickness of sample (t=0.5 mm)

$\delta_0$: initial deflection displacement (2 mm)

$L_s$: span length (mm)

The residual stress ratio was measured based on the bending habit after storage at a temperature of 150° C. for 1000 hours and the stress relaxation resistance was evaluated. Further, the residual stress ratio was calculated using the following equation.

$$\text{Residual stress ratio(\%)}=(1-\delta_t/\delta_0)\times 100$$

Here, the conditions are as follows.

$\delta_t$: permanent deflection displacement (mm) after storage at 150° C. for 1000 hours—permanent deflection displacement (mm) after storage at room temperature for 24 hours $\delta_0$: initial deflection displacement (mm)

(Bending Workability)

Bend working was performed in conformity with a 4 test method in Japan Elongated Copper Association Technical Standard JCBA-T307:2007. A plurality of test pieces having a width of 10 mm and a length of 30 mm were collected from each thin plate for evaluating characteristics such that the bending axis was in a direction orthogonal to the rolling direction. A W bending test was performed using a jig in which the bending angle was set to 90 degrees, and the bending radius was set to 0.5 mm (R/t=1.0) in a case where the finish rolling ratio was greater than 85% or set to 0.3 mm (R/t=0.6) in a case where the finish rolling ratio was 85% or less.

Determination was made such that a case where the outer peripheral portion of a bent portion was visually observed and cracks were found was evaluated as "C", a case where large wrinkles were observed was evaluated as B, and a case where breakage, fine cracks, or large wrinkles were not found was evaluated as A. Further, A and B were determined as acceptable bending workability. The evaluation results are listed in Table 3.

TABLE 1

| | | Mg (mass %) | P (mass %) | Cu | [Mg] + 20 × [P] | [Mg]/[P] |
|---|---|---|---|---|---|---|
| Examples of the present invention | 1 | 0.15 | 0.0025 | Remainder | 0.20 | 60 |
| | 2 | 0.16 | 0.0091 | Remainder | 0.34 | 18 |
| | 3 | 0.18 | 0.0074 | Remainder | 0.33 | 24 |
| | 4 | 0.19 | 0.0032 | Remainder | 0.25 | 59 |
| | 5 | 0.21 | 0.0006 | Remainder | 0.22 | 350 |
| | 6 | 0.23 | 0.0009 | Remainder | 0.25 | 256 |
| | 7 | 0.26 | 0.0077 | Remainder | 0.41 | 34 |
| | 8 | 0.24 | 0.0082 | Remainder | 0.40 | 29 |
| | 9 | 0.25 | 0.0098 | Remainder | 0.45 | 26 |
| | 10 | 0.30 | 0.0007 | Remainder | 0.31 | 429 |
| | 11 | 0.20 | 0.0060 | Remainder | 0.32 | 33 |
| | 12 | 0.21 | 0.0023 | Remainder | 0.26 | 91 |
| | 13 | 0.22 | 0.0072 | Remainder | 0.36 | 31 |
| | 14 | 0.23 | 0.0056 | Remainder | 0.34 | 41 |
| | 15 | 0.25 | 0.0024 | Remainder | 0.30 | 104 |
| | 16 | 0.25 | 0.0013 | Remainder | 0.28 | 192 |
| | 17 | 0.24 | 0.0016 | Remainder | 0.27 | 150 |
| | 18 | 0.25 | 0.0014 | Remainder | 0.28 | 179 |
| | 19 | 0.29 | 0.0078 | Remainder | 0.45 | 37 |
| | 20 | 0.27 | 0.0072 | Remainder | 0.41 | 38 |
| | 21 | 0.25 | 0.0066 | Remainder | 0.38 | 38 |
| | 22 | 0.23 | 0.0059 | Remainder | 0.35 | 39 |
| | 23 | 0.29 | 0.0091 | Remainder | 0.47 | 32 |
| | 24 | 0.31 | 0.0042 | Remainder | 0.39 | 74 |
| | 25 | 0.32 | 0.0009 | Remainder | 0.34 | 356 |
| | 26 | 0.33 | 0.0090 | Remainder | 0.51 | 37 |
| | 27 | 0.34 | 0.0072 | Remainder | 0.48 | 47 |
| | 28 | 0.16 | 0.0013 | Remainder | 0.19 | 123 |
| | 29 | 0.17 | 0.0053 | Remainder | 0.28 | 32 |
| | 30 | 0.18 | 0.0042 | Remainder | 0.26 | 43 |
| | 31 | 0.23 | 0.0016 | Remainder | 0.26 | 144 |
| | 32 | 0.25 | 0.0036 | Remainder | 0.32 | 69 |
| | 33 | 0.25 | 0.0051 | Remainder | 0.35 | 49 |
| | 34 | 0.25 | 0.0062 | Remainder | 0.37 | 40 |
| Comparative examples | 1 | 0.02 | 0.0016 | Remainder | 0.05 | 13 |
| | 2 | 0.58 | 0.0032 | Remainder | 0.64 | 181 |
| | 3 | 0.31 | 0.0975 | Remainder | 2.26 | 3 |
| | 4 | 0.34 | 0.0092 | Remainder | 0.52 | 37 |
| | 5 | 0.33 | 0.0088 | Remainder | 0.51 | 38 |

TABLE 2

| | | Casting Cooling | Homogenizing/ solutionizing | Rough rolling Rolling | Intermediate heat treatment | | Finish rolling Rolling | Finish heat treatment | |
|---|---|---|---|---|---|---|---|---|---|
| | | rate (° C./sec) | Temperature (° C.) | ratio (%) | Temperature (° C.) | Time (sec) | ratio (%) | Temperature (° C.) | Time (sec) |
| Examples of the present invention | 1 | 25 | 500 | 85 | 525 | 10 | 65 | 350 | 60 |
| | 2 | 0.6 | 500 | 60 | 500 | 15 | 50 | 300 | 60 |
| | 3 | 25 | 600 | 75 | 575 | 5 | 70 | 325 | 60 |
| | 4 | 25 | 700 | 80 | 575 | 10 | 50 | 350 | 60 |
| | 5 | 25 | 700 | 65 | 600 | 5 | 60 | 300 | 60 |
| | 6 | 25 | 700 | 85 | 550 | 10 | 60 | 300 | 60 |
| | 7 | 25 | 700 | 60 | 600 | 5 | 50 | 350 | 60 |
| | 8 | 25 | 700 | 55 | 600 | 5 | 40 | 300 | 60 |
| | 9 | 25 | 700 | 50 | 575 | 15 | 50 | 350 | 60 |
| | 10 | 25 | 700 | 75 | 600 | 10 | 70 | 350 | 60 |
| | 11 | 25 | 700 | 50 | 650 | 5 | 25 | 350 | 60 |
| | 12 | 25 | 700 | 60 | 625 | 10 | 30 | 350 | 60 |
| | 13 | 25 | 700 | 90 | 525 | 5 | 60 | 250 | 60 |
| | 14 | 25 | 700 | 85 | 525 | 20 | 65 | 275 | 60 |
| | 15 | 25 | 700 | 75 | 575 | 10 | 60 | 500 | 60 |
| | 16 | 25 | 700 | 85 | 575 | 10 | 60 | 350 | 60 |
| | 17 | 25 | 700 | 60 | 575 | 10 | 85 | 350 | 60 |
| | 18 | 25 | 700 | 85 | 550 | 15 | 40 | 350 | 60 |
| | 19 | 0.6 | 500 | 50 | 500 | 10 | 50 | 300 | 60 |

TABLE 2-continued

| | | Casting Cooling rate (° C./sec) | Homogenizing/ solutionizing Temperature (° C.) | Rough rolling Rolling ratio (%) | Intermediate heat treatment Temperature (° C.) | Intermediate heat treatment Time (sec) | Finish rolling Rolling ratio (%) | Finish heat treatment Temperature (° C.) | Finish heat treatment Time (sec) |
|---|---|---|---|---|---|---|---|---|---|
| | 20 | 0.6 | 600 | 55 | 525 | 10 | 40 | 350 | 60 |
| | 21 | 1.2 | 600 | 50 | 550 | 10 | 35 | 350 | 60 |
| | 22 | 1.2 | 600 | 60 | 525 | 15 | 30 | 350 | 60 |
| | 23 | 25 | 700 | 70 | 575 | 10 | 85 | 350 | 60 |
| | 24 | 25 | 715 | 75 | 600 | 5 | 60 | 325 | 60 |
| | 25 | 25 | 715 | 80 | 600 | 10 | 60 | 300 | 60 |
| | 26 | 25 | 715 | 40 | 625 | 10 | 65 | 300 | 180 |
| | 27 | 25 | 715 | 50 | 600 | 10 | 60 | 300 | 60 |
| | 28 | 25 | 500 | 60 | 500 | 10 | 88 | 325 | 60 |
| | 29 | 25 | 500 | 55 | 550 | 10 | 92 | 350 | 60 |
| | 30 | 25 | 550 | 50 | 575 | 5 | 90 | 350 | 60 |
| | 31 | 25 | 600 | 30 | 550 | 20 | 95 | 300 | 60 |
| | 32 | 25 | 650 | 60 | 575 | 10 | 75 | 350 | 60 |
| | 33 | 25 | 650 | 60 | 575 | 10 | 75 | 350 | 60 |
| | 34 | 25 | 650 | 60 | 575 | 10 | 75 | 350 | 60 |
| Comparative examples | 1 | 25 | 500 | 60 | 400 | 15 | 30 | 250 | 60 |
| | 2 | 25 | 700 | 50 | 600 | 10 | 60 | 350 | 60 |
| | 3 | 25 | 715 | Edge cracking largely occurred in rough rolling step and subsequent steps were stopped | | | | | |
| | 4 | 0.4 | 500 | 50 | 500 | 3600 | 60 | 350 | 60 |
| | 5 | 0.4 | 650 | 50 | 600 | 20 | 92 | 300 | 60 |

TABLE 3

| | | Castability | Compounds (pieces/μm²) Particle diameter 0.05 μm or greater | Compounds (pieces/μm²) Particle diameter 0.1 μm or greater | 0.2% proof stress (MPa) | Conductivity (% IACS) | Residual stress ratio (%) | Bending workability |
|---|---|---|---|---|---|---|---|---|
| Examples of the present invention | 1 | A | 0 | 0 | 347 | 88.6 | 62.0 | A |
| | 2 | A | 0.04 | 0 | 352 | 87.6 | 58.0 | B |
| | 3 | A | 0 | 0 | 409 | 86.5 | 66.0 | A |
| | 4 | A | 0 | 0 | 360 | 85.9 | 75.0 | A |
| | 5 | B | 0 | 0 | 402 | 84.2 | 74.0 | A |
| | 6 | B | 0 | 0 | 439 | 82.5 | 72.0 | A |
| | 7 | A | 0 | 0 | 388 | 80.8 | 83.0 | B |
| | 8 | A | 0 | 0 | 370 | 82.5 | 76.0 | B |
| | 9 | A | 0 | 0 | 401 | 82.1 | 75.0 | B |
| | 10 | B | 0 | 0 | 438 | 79.2 | 84.0 | A |
| | 11 | A | 0 | 0 | 303 | 85.4 | 84.0 | A |
| | 12 | A | 0 | 0 | 327 | 84.8 | 81.0 | A |
| | 13 | A | 0 | 0 | 442 | 83.7 | 52.0 | A |
| | 14 | A | 0 | 0 | 440 | 83.3 | 59.0 | A |
| | 15 | A | 0 | 0 | 352 | 82.4 | 85.0 | A |
| | 16 | A | 0 | 0 | 404 | 82.2 | 84.0 | A |
| | 17 | A | 0 | 0 | 461 | 82.8 | 82.0 | A |
| | 18 | A | 0 | 0 | 353 | 82.4 | 84.0 | A |
| | 19 | A | 2.20 | 0.48 | 425 | 79.8 | 71.0 | B |
| | 20 | A | 1.86 | 0.44 | 364 | 81.1 | 81.0 | B |
| | 21 | A | 0.44 | 0.14 | 351 | 82.0 | 76.0 | B |
| | 22 | A | 0.31 | 0.08 | 342 | 83.2 | 83.0 | B |
| | 23 | A | 0 | 0 | 475 | 79.6 | 82.0 | B |
| | 24 | A | 0 | 0 | 439 | 77.8 | 77.0 | A |
| | 25 | B | 0 | 0 | 458 | 77.2 | 75.0 | A |
| | 26 | A | 0 | 0 | 432 | 76.3 | 75.0 | B |
| | 27 | A | 0 | 0 | 458 | 75.2 | 77.0 | A |
| | 28 | A | 0 | 0 | 479 | 86.8 | 61.0 | A |
| | 29 | A | 0 | 0 | 480 | 86.0 | 72.0 | A |
| | 30 | A | 0 | 0 | 503 | 85.6 | 74.0 | A |
| | 31 | A | 0 | 0 | 554 | 81.3 | 54.0 | B |
| | 32 | A | 0 | 0 | 440 | 81.4 | 80.0 | A |
| | 33 | A | 0 | 0 | 436 | 81.7 | 78.0 | A |
| | 34 | A | 0 | 0 | 432 | 82.0 | 77.0 | B |

TABLE 3-continued

| | | Castability | Compounds (pieces/μm²) Particle diameter 0.05 μm or greater | Particle diameter 0.1 μm or greater | 0.2% proof stress (MPa) | Conductivity (% IACS) | Residual stress ratio (%) | Bending workability |
|---|---|---|---|---|---|---|---|---|
| Comparative examples | 1 | A | 0 | 0 | 274 | 97.6 | 32.0 | A |
| | 2 | A | 0 | 0 | 482 | 65.0 | 86.0 | A |
| | 3 | B | Edge cracking largely occurred in rough rolling step and subsequent steps were stopped | | | | | |
| | 4 | A | 4.20 | 0.82 | 422 | 75.6 | 71.0 | C |
| | 5 | A | 4.00 | 1.30 | 572 | 75.6 | 64.0 | C |

In Comparative Example 1, the content of Mg was smaller than the ratio of the present disclosure (0.15 mass % or greater and less than 0.35 mass %), the proof stress and the stress relaxation resistance were insufficient.

In Comparative Example 2, the content of Mg was larger than the range of the present disclosure (0.15 mass % or greater and less than 0.35 mass %), and the conductivity was low.

In Comparative Example 3, since the content of P was larger than the range of the present disclosure (0.0005 mass % or greater and less than 0.01 mass %) and cracking largely occurred in intermediate rolling, the evaluation was not able to be performed.

In Comparative Examples 4 and 5, since the contents of Mg and P were large and the cooling rate during casting was low, the amount of compounds was large and the bending workability was degraded.

On the contrary, in the examples of the present invention, it was confirmed that the castability, the strength (0.2% proof stress), the conductivity, the stress relaxation resistance (residual stress ratio), and the bending workability were excellent.

Based on the results obtained above, according to the examples of the present invention, it was confirmed that a copper alloy for electronic and electrical equipment and a copper alloy plate strip for electronic and electrical equipment with excellent conductivity and bending workability can be provided.

INDUSTRIAL APPLICABILITY

Even in a case of being used for a member whose thickness was reduced along with miniaturization, it is possible to provide a copper alloy for electronic and electrical equipment, a copper alloy plate strip for electronic and electrical equipment, a component for electronic and electrical equipment, a terminal, a busbar, and a movable piece for a relay with excellent conductivity and bending workability.

The invention claimed is:

1. A copper alloy for electronic and electrical equipment consisting of:

0.15 mass % or greater and less than 0.35 mass % of Mg;

0.0005 mass % or greater and less than 0.01 mass % of P; and a remainder which is formed of Cu and unavoidable impurities, wherein a conductivity is greater than 75% IACS, an average number of compounds containing Mg and P with a particle diameter of 0.1 μm or greater is 0.5 pieces/m² or less in observation using a scanning electron microscope, a content [Mg] (mass %) of Mg and a content [P] (mass %) of P satisfy a relational expression of [Mg]/[P]>25, and a residual stress ratio is 50% or greater under conditions of 150° C. for 1000 hours.

2. The copper alloy for electronic and electrical equipment according to claim 1, wherein the content [Mg] (mass %) of Mg and the content [P] (mass %) of P satisfy a relational expression of [Mg]+20×[P]<0.5.

3. The copper alloy for electronic and electrical equipment according to claim 1, wherein the content [Mg] (mass %) of Mg and the content [P] (mass %) of P satisfy a relational expression of [Mg]/[P]≤400.

4. The copper alloy for electronic and electrical equipment according to claim 1, wherein a 0.2% proof stress measured at the time of a tensile test performed in a direction orthogonal to a rolling direction is 300 MPa or greater.

5. A copper alloy plate strip for electronic and electrical equipment comprising:

the copper alloy for electronic and electrical equipment according to claim 1.

6. The copper alloy plate strip for electronic and electrical equipment according to claim 5, wherein the copper alloy plate strip includes a Sn plating layer or a Ag plating layer on a surface of the copper alloy plate strip.

7. A component for electronic and electrical equipment comprising:

the copper alloy plate strip for electronic and electrical equipment according to claim 5.

8. The component for electronic and electrical equipment according to claim 7, wherein the component includes a Sn plating layer or a Ag plating layer on a surface of the component.

9. A terminal comprising:

the copper alloy plate strip for electronic and electrical equipment according to claim 5.

10. The terminal according to claim 9, wherein the terminal includes a Sn plating layer or a Ag plating layer on a surface of the terminal.

11. A busbar comprising:

the copper alloy plate strip for electronic and electrical equipment according to claim 5.

12. The busbar according to claim 11, wherein the busbar includes a Sn plating layer or a Ag plating layer on a surface of the busbar.

13. A movable piece for a relay comprising:

the copper alloy plate strip for electronic and electrical equipment according to claim 5.

14. The movable piece for a relay according to claim 13, wherein the movable piece includes a Sn plating layer or a Ag plating layer on a surface of the movable piece.

* * * * *